US008701884B2

(12) United States Patent
Williams et al.

(10) Patent No.: US 8,701,884 B2
(45) Date of Patent: Apr. 22, 2014

(54) SHIPPING CONTAINER FOR BOTTLES

(76) Inventors: Kevin Gregg Williams, Salt Lake City, UT (US); William Michael Phillips, Draper, UT (US)

( * ) Notice: Subject to any disclaimer, the term of this patent is extended or adjusted under 35 U.S.C. 154(b) by 383 days.

(21) Appl. No.: 12/728,045

(22) Filed: Mar. 19, 2010

(65) Prior Publication Data

US 2010/0326858 A1 Dec. 30, 2010

Related U.S. Application Data

(60) Provisional application No. 61/220,188, filed on Jun. 24, 2009.

(51) Int. Cl.
*B65D 65/00* (2006.01)

(52) U.S. Cl.
USPC ..... 206/429; 206/427; 206/139

(58) Field of Classification Search
USPC ..... 206/429, 427, 158, 148, 139
See application file for complete search history.

(56) References Cited

U.S. PATENT DOCUMENTS 1,367,069 A * 2/1921 MacKinnon ..... 217/21
2,886,828 A 5/1959 Lattuca
3,294,270 A * 12/1966 Geisler ..... 217/21
3,650,395 A * 3/1972 Hobbs ..... 206/139
3,752,305 A * 8/1973 Heyne ..... 206/147
3,912,075 A * 10/1975 Berry ..... 206/158
4,037,722 A * 7/1977 Bremer ..... 206/523
4,113,095 A 9/1978 Dietz et al.
4,625,908 A * 12/1986 Emery ..... 206/427
4,634,002 A * 1/1987 Delonghi ..... 206/158
4,911,300 A * 3/1990 Colonna ..... 206/427
4,944,400 A 7/1990 Van Onstein et al.
5,144,897 A 9/1992 Avery
5,259,508 A 11/1993 Beckerman
5,335,770 A 8/1994 Baker et al.
5,366,080 A 11/1994 Carstersen et al.
5,377,862 A * 1/1995 Oakes et al. ..... 220/513
D361,431 S 8/1995 Koefelda
5,769,235 A 6/1998 Keach et al.
5,938,011 A * 8/1999 Holzapfel et al. ..... 206/203
5,975,300 A 11/1999 Gale
6,123,200 A 9/2000 Stephens et al.
6,213,297 B1 * 4/2001 Gale ..... 206/427
6,290,057 B1 * 9/2001 Hurley ..... 206/203
6,298,989 B1 10/2001 Chu
6,325,210 B1 * 12/2001 Henry, Jr. ..... 206/427
6,500,369 B1 12/2002 Gorowiez et al.
6,679,380 B2 1/2004 Brown
6,702,115 B1 * 3/2004 Roper ..... 206/427
6,786,334 B2 9/2004 Smith
6,805,241 B2 10/2004 Smith
6,820,743 B2 * 11/2004 Hurley et al. ..... 206/427
6,948,293 B1 9/2005 Eckermann et al.
7,093,717 B2 * 8/2006 Sakai et al. ..... 206/591

(Continued)

*Primary Examiner* — Fenn Mathew
*Assistant Examiner* — Christopher McKinley
(74) *Attorney, Agent, or Firm* — Pate Peterson PLLC; Brett Peterson

(57) ABSTRACT

A shipping container for glass bottles such as are used with wine or juice is provided. The shipping container has a lower tray and an upper tray which fit inside of a cardboard box. The upper tray engages the shoulder of the bottle rather than the neck or cap of the bottle and thus holds the bottle more securely and with less risk of damage to the bottle or shipping tray when the cardboard box is dropped or when weight is placed thereon.

20 Claims, 6 Drawing Sheets

(56) References Cited

U.S. PATENT DOCUMENTS

| | | | | |
|---|---|---|---|---|
| D561,588 | S * | 2/2008 | Gilfert | D9/456 |
| 7,789,239 | B2 * | 9/2010 | Juliano | 206/564 |
| 2005/0189243 | A1 * | 9/2005 | Manabe et al. | 206/139 |
| 2006/0137073 | A1 | 6/2006 | Crisco | |
| 2006/0243784 | A1 * | 11/2006 | Glaser et al. | 229/117.16 |
| 2008/0135445 | A1 * | 6/2008 | Juliano | 206/592 |
| 2008/0302691 | A1 * | 12/2008 | Olson et al. | 206/427 |

* cited by examiner

SHIPPING CONTAINER FOR BOTTLES

PRIORITY

The present application claims the benefit of U.S. Provision Application Ser. No. 61/220,188, filed Jun. 24, 2009, which is herein incorporated by reference in its entirety.

THE FIELD OF THE INVENTION

The present invention relates to a shipping container for bottles. More specifically, the present invention relates to a shipping container for glass wine bottles and other glass bottles having a shape similar to wine bottles.

BACKGROUND

It has become more and more common to ship small quantities of bottled wine, fruit juices, or the like through a postal service or through parcel shipping services. Previously, larger quantities of bottled wine or juice had been transported through conventional grocery and foodservice delivery chains, and the bottles or wine or juice are purchased locally by a person and taken home for consumption.

It has become desirable, however, for individuals to purchase bottled juice or wine from out of state companies and have the purchased bottles shipped to the customer. This provides greater selection to the customer and allows the customer to purchase bottles of juice or wine which are not available locally. Thus, a customer may purchase specific desired items which would be otherwise unavailable.

The direct purchasing and shipping of small quantities of bottles to the consumer has, however, caused some shipping problems. When a larger quantity of bottles is transported to a store, these may be transported together on a pallet. This generally ensures that the bottles are kept upright and are not dropped or otherwise subjected to undue forces. When bottles are delivered through a parcel service or the postal service, they are packaged in a box and the box may often be shipped in any orientation and may be dropped in transportation. As such, the packaging requirements for glass bottles requires that the bottles are not broken when the package is dropped from various heights or placed with a load on top of the package while vibrating the package for extended periods of time. The packaging must still provide sufficient protection to the bottles after the dropping and vibration tests in addition to surviving the tests without the bottles breaking. Many available shipping containers do not properly support a bottle and increase the likelihood that the bottle breaks during shipping.

In addition to meeting the shipping requirement, it is desirable that the packaging meet several other requirements, such as being quick and easy to use and being compact. A package, even if it meets the shipping requirements, is not very useful if it is time consuming to assemble and use. Many available shipping containers, such as 3-dimensional assemblies built from flat cardboard, require a significant amount of time to put together separate pieces and assemble the container. While these shipping containers may be inexpensive, the labor cost to use the containers adds significantly to the cost. Other available shipping containers, such as molded foam cradles, can not be made any smaller than the completed size of the package, and thus take up a very large amount of space. These containers are thus inconvenient to use as they overwhelm workstation and storage areas. Requiring a large amount of time for assembly and use, or requiring a large amount of space for storage before use increase the cost of a shipping container and make these undesirable shipping options.

Prior art storage and carrying containers typically have receptacles which engage the bottom of a bottle and the top of the bottle caps. Many of these containers, however, are unable to meet the rigorous drop and vibration tests for shipping via postal or parcel services. Prior art shipping containers are known which meet the testing requirements for shipping, but these are more expensive and less convenient to use.

One type of prior art containers is a three-dimensional assembly of flat cardboard pieces combined with a cardboard tube which engages the bottles and is placed inside of a box. This device, however, is difficult to assemble and requires a significant amount of worker time to use. Another type of prior art container has an expanded styrene 'coffin' with a lid which receives the bottle and entirely surrounds the bottle. This device is inconvenient to use because it does not nest, requiring its entire assembled volume to ship to a retailer or store, increasing the cost and inconvenience associated with the use of the device.

It is thus appreciated that, with the desirable attributes of a shipping container, prior art containers have fallen short in some measure. There is a need for a shipping container for glass bottles which securely holds and protects the bottle so as to withstand the rigors of shipping and the requirement of testing. There is a need for a shipping container which is also inexpensive, easy to use and does not require a large amount of space for storage.

SUMMARY OF THE INVENTION

It is an object of the present invention to provide an improved shipping container for glass bottles.

According to one aspect of the invention, a two part container is provided which engages the bottom of a bottle and the shoulder of a bottle. Such a shipping container more securely holds the bottle and increases the ability of the container to protect the bottle during shipping.

According to another aspect of the invention, the shipping container is made from paper or other fiber pulp. Such a container provides increased resiliency and reduces damage to the container itself.

According to another aspect of the invention, the shipping container is nestable within other of said shipping containers, allowing a large quantity of the shipping containers to be transported and stored in a minimal space. The shipping container is easily used as it is molded and does not need assembly.

These and other aspects of the present invention are realized in a shipping container for bottles as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
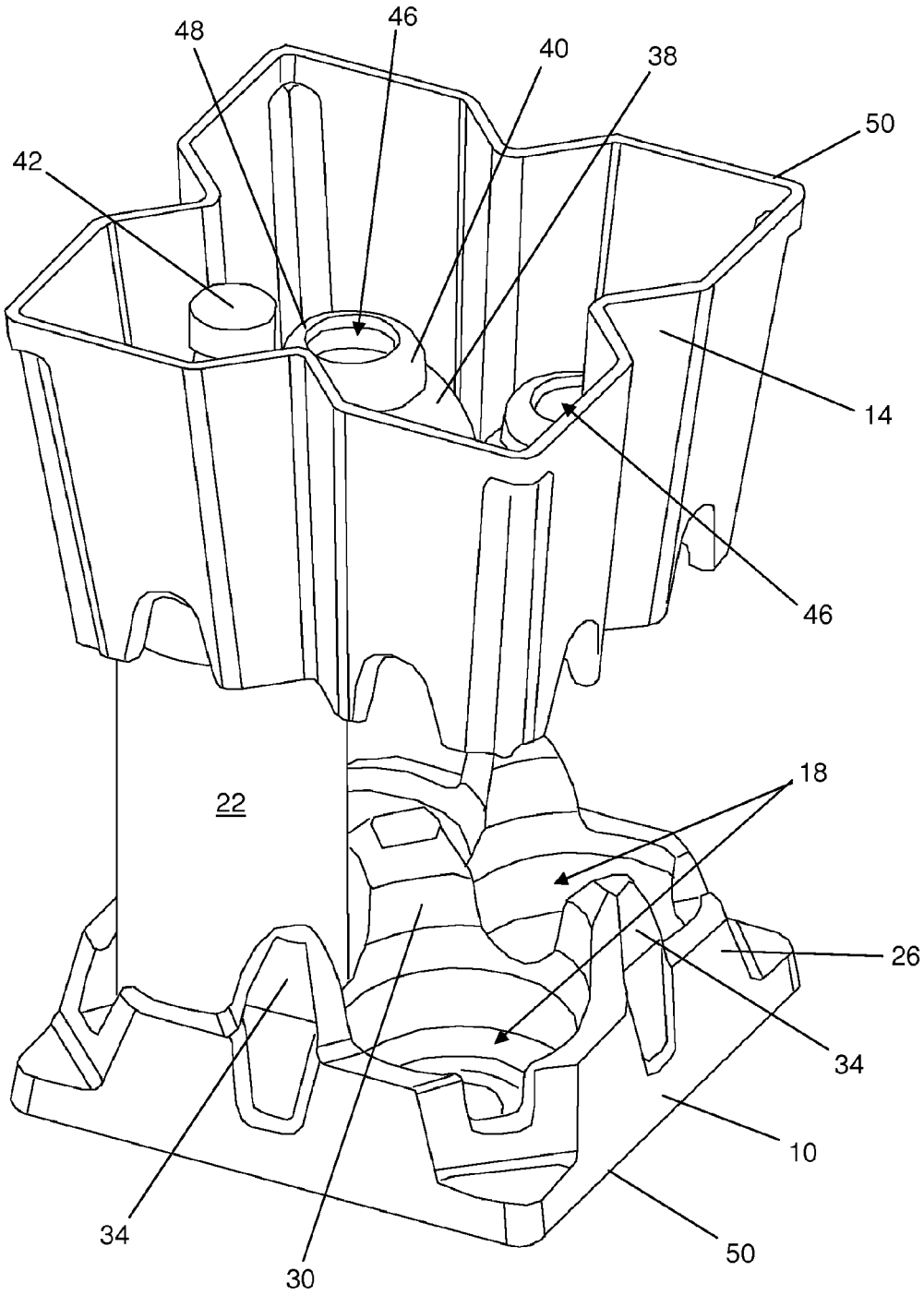
FIG. 1 shows a perspective view of shipping container trays of the present invention.
Figure 2:
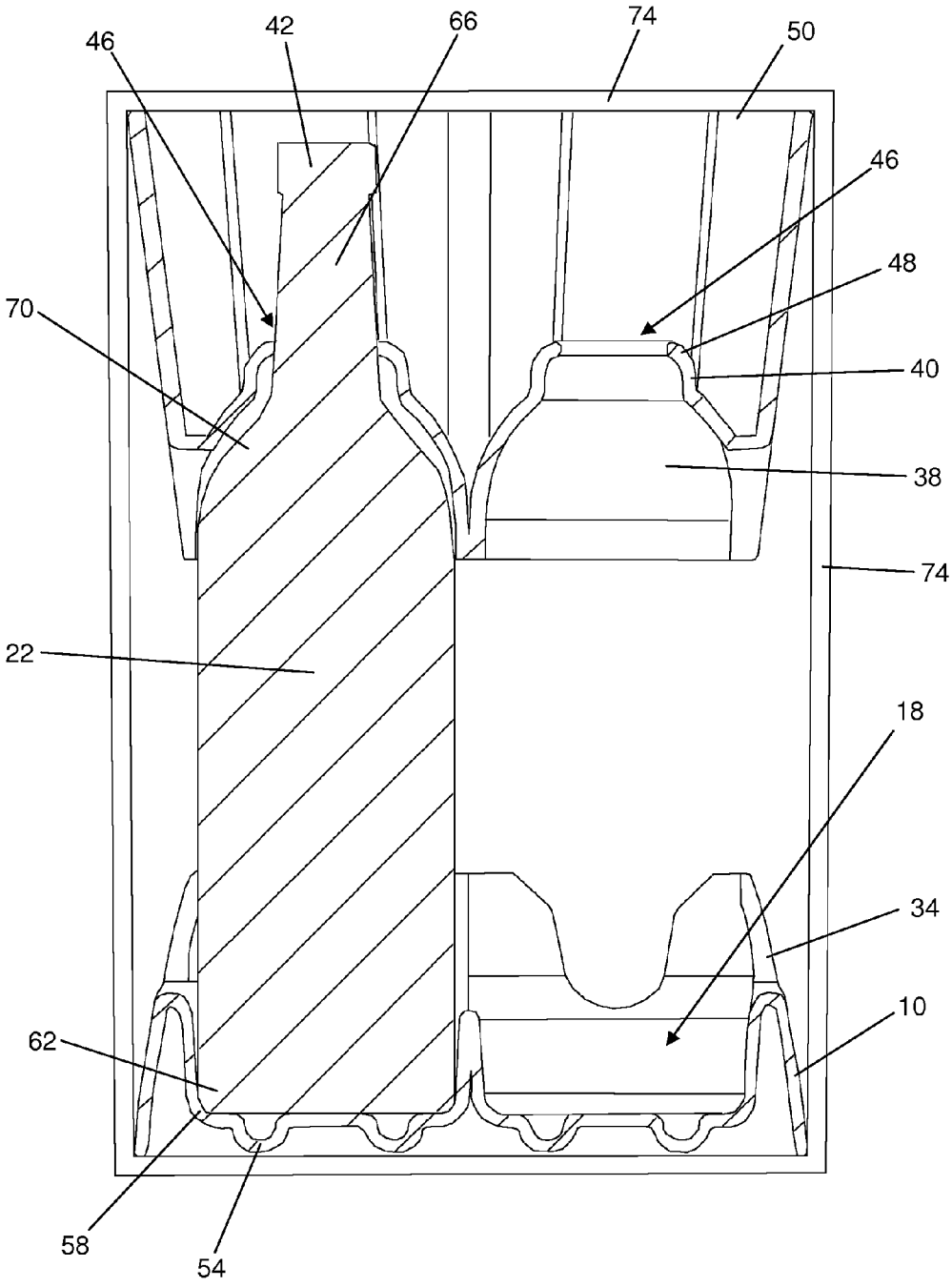
FIG. 2 shows a sectional view of the shipping container of FIG. 1 inside of a box.
Figure 3:
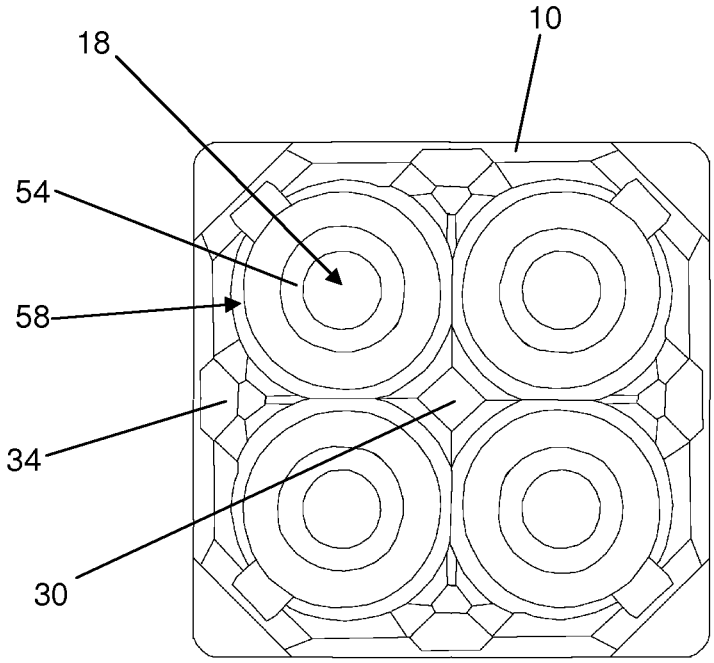
FIGS. 3 and 4 show the lower tray of the container of FIG. 1.
Figure 4:
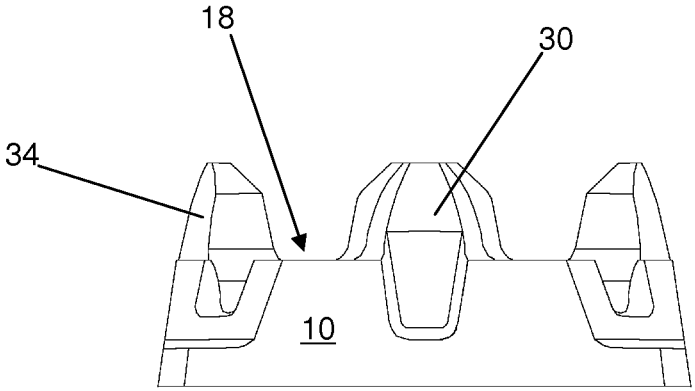
Figure 5:
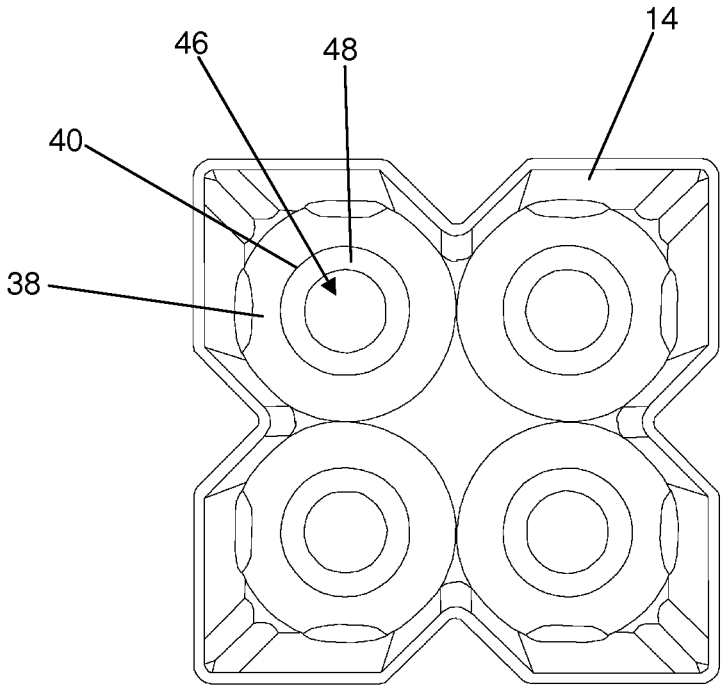
FIGS. 5 and 6 show the upper tray of the container of FIG. 1.
Figure 6:
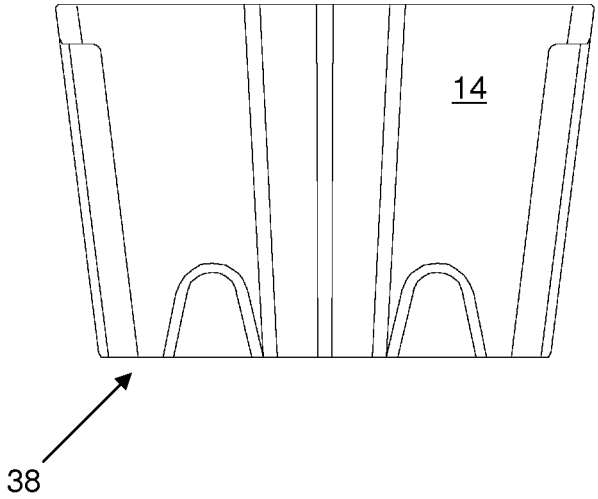

Turning now to FIG. 1, a perspective view of a bottle packaging insert according to the present invention is shown. The insert includes a bottom tray 10 and a top tray 14. The insert is placed with bottles in the configuration shown inside of a cardboard box for shipping. As shown in FIGS. 5 and 6, the insert may be made to hold different numbers of bottles, such as two or three bottles, while maintaining essentially the same structures shown in FIGS. 1 through 4. FIGS. 2 through 4 show sectional and isometric views of the insert of FIG. 1.

The bottom tray 10 includes receptacles 18 which receive the bottom of a bottle 22. The tray 10 is formed with sidewalls 26 around the receptacles to securely hold the bottle, and is formed with an extended center post 30 and side posts 34 which more securely keep the bottles 22 spaced apart from each other and spaced apart from the walls of a cardboard box during shipping.

The top tray 14 is also formed with receptacles 38 which receive the shoulder of a bottle 22. The receptacles are unique in that they do not engage the top of the bottle (such as the bottle cap 42) but engage the shoulder of the bottle and allow the bottle neck and cap 42 to extend through the receptacle 38 through a hole 46. The receptacles 18, 38 are typically formed so as to create an interference fit with a particular size of bottle 22, thereby holding the bottle more securely.

Both the bottom tray 10 and the top tray 14 are hollow and are of a slightly tapered shape (becoming narrower when moving away from the ends 50 thereof) and as such are nestable. This allows the bottom tray 10 and top tray 14 to be stacked for convenient shipping and storage. Since the trays are preformed and require no other assembly other than fitting the bottles into the tray, they require little time to use.

FIG. 2 shows a cross-sectional view of the trays 10, 14 and more clearly illustrates various aspects of the trays 10, 14. The bottom tray 10 is formed so that the receptacles 18 have a ridge 54 formed in the bottom. The ridge 54 separates the bottom of the bottle 22 from the cardboard box and provides some compressibility to avoid breakage of the bottle 22. The receptacles 18 are also formed with a rounded lower shoulder 58 which engages the lower edge 62 of the bottle 22. These features aid in holding the bottle 22 securely and in preventing damage to the bottle if the box is dropped.

The top tray 14 is formed so that the receptacles are located a substantial distance away from the end 50 of the tray 14. As seen, the bottle cap 42 and neck 66 extend through an opening 46 in the receptacle 38, and the receptacle engages the shoulder 70 of the bottle 22. The receptacle 38 has a broadly rounded surface which both matches the shoulder of the bottle and creates a stronger receptacle because it diffuses the stresses of carrying the bottle during shipping across a larger area. As is seen, the hole 46 is formed by an annular ring 40 with an inwardly curving upper edge 48 which extends upwardly from the rounded portion of the receptacle 38. The ring 40 and curved edge 48 strengthen both the hole 46 as well as the receptacle 38. There is sufficient distance between the receptacle 38 and the end 50 of the tray 14 to keep the bottle cap 42 spaced away from the cardboard box used to house the bottle 22 and trays 10, 14.

The receptacle thus provides several advantages. The receptacle 38 is much larger than a prior art receptacle which engages the cap 42, and as such is a stronger receptacle. The receptacle is stronger because it engages the tray 14 at a larger perimeter, and because it is not attached to the tray 14 via an extended flat section of the tray. This makes the receptacle 38 less likely to become damaged during shipping. Additionally, the receptacle 38 is advantageous as it holds the bottle 22 on the shoulder 70 rather than the neck 66 and/or cap 42, holding the bottle in a stronger region of the bottle and making the bottle itself less likely to break due to later forces imposed on the bottle during shipping. Prior art shipping containers which hold a bottle by the cap place significant bending forces on the bottle neck 66 when dropped or hit sideways, and are more likely to break the bottle neck 66.

FIG. 2 shows the box 74 into which the lower tray 10, bottles 22 and upper tray 14 are placed. The lower tray 10 and upper tray 14 keep the bottle away from the box 74 so that damage to the box will not result in damage to the bottles in most situations. If elevated forces are applied to the box 74, there is some room for the box 74 and the trays 10, 14 to bend or crush while still preventing the bottle 22 from contacting the side of the box.

Figure 7:
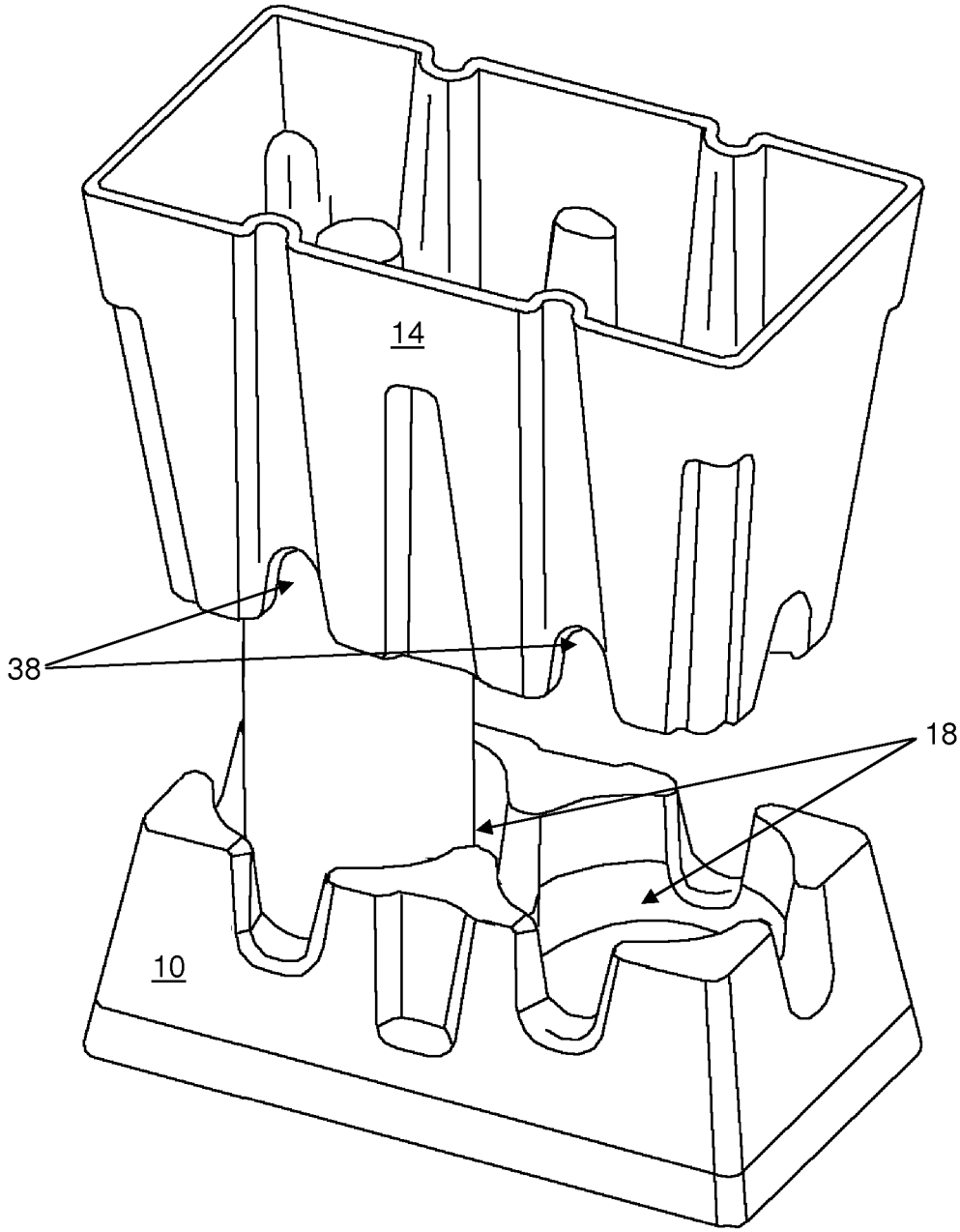
FIG. 7 shows a container of the present invention configured for carrying two bottles.
Figure 8:
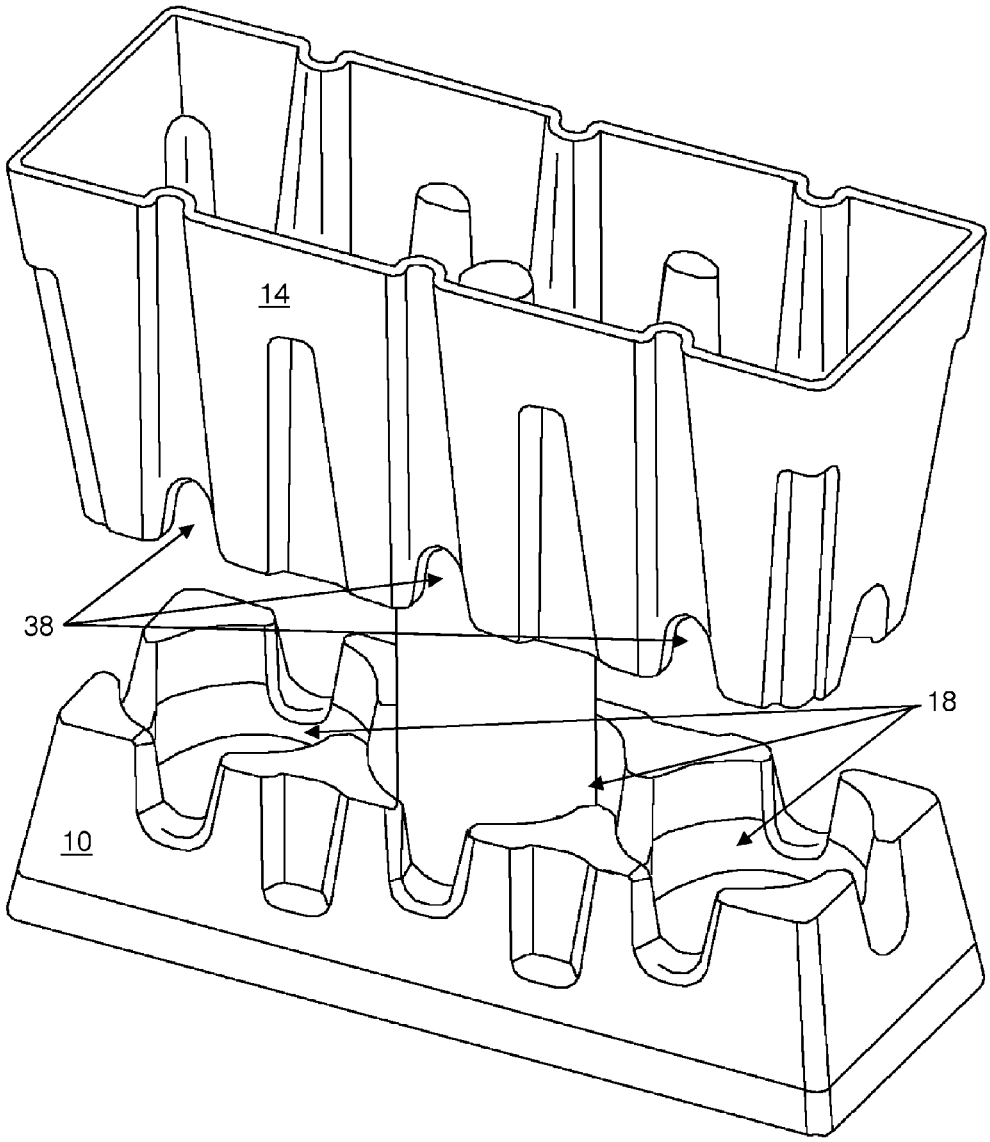
FIG. 8 shows a container of the present invention configured for carrying three bottles.

FIGS. 3 through 6 show end views and side views of the lower tray 10 and upper tray 14, respectively. FIGS. 7 and 8 show perspective views of lower and upper trays 10, 14 which are configured for two or three bottles. Although these figures do not include all of the reference numbers used in FIGS. 1 through 6 for clarity, it is seen that they contain the various structures described in reference to FIGS. 1 through 6. Thus, the trays 10, 14 shown in FIGS. 7 and 8 have the same receptacles 18, 38, and hold a bottle 22 in the same manner as is discussed above.

Typically, the upper tray 10 and lower tray 14 are formed from a paper or fiber pulp. This material is advantageous in its ability to absorb impact and deform somewhat without cracking, as may often occur with a molded plastic or foam. The pulp material still remains nestable, however, making the trays easier to store and use. The present shipping container is thus advantageous for many reasons. Because the trays 10, 14 do not require any assembly, there is very little labor required to prepare bottles 22 for shipping and the packaging and shipping of bottles may be performed quite quickly. Since the trays 10, 14 are nestable, they are more convenient to both store and use. A worker may have a large number of shipping trays 10, 14 at a shipping station without consuming an excessive space. The worker need not frequently replenish supplies of shipping containers, and can conveniently draw from a stack of shipping trays.

Applicants have found that the present shipping container has been able to withstand the rigorous drop and strength testing necessary for approval for use with postage and parcel shipping companies. Other tray type shipping containers have not been able to pass the testing for use as a parcel shipping container. The shipping trays 10, 14 provide increased resistance to breakage and, even when dropped, continue to provide meaningful protection to the bottles 22. Some prior art packages will allow the bottle to rest against the cardboard box after initial damage, making breakage of the bottle much more likely during subsequent impacts. Conversely, structural features of the present invention such as the ridges 54 and the enlarged receptacles 38 maintain support and protection for bottles 22 even after some initial damage to the shipping trays 10, 14. The shipping trays 10, 14 have shown a decrease in bottle breakage as compared to previously available shipping containers.

Applicants have experienced a rapid increase in sales of the packaging trays 10, 14 since introducing the shipping container to customers. Applicants have determined that the rapid adoption by customers was due to a significantly reduced rate of broken bottles during shipping, the ease of use, low cost, and the ease of transportation and storage of unused shipping containers.

There is thus disclosed an improved shipping container for glass bottles. It will be appreciated that numerous changes may be made to the present invention without departing from the scope of the claims.

What is claimed is:

1. A shipping container for bottles having a body portion of a first size, a neck portion of a reduced size, and a shoulder portion defining a transition between the body portion and the neck portion, the shipping container comprising:

a lower tray, the lower tray comprising:

a lower receptacle for receiving the bottom of a bottle; and an upper tray, the upper tray comprising:

an upper receptacle for receiving the shoulder of the bottle such that the receptacle extends around the shoulder of the bottle to the bottle body; and a support wall attaching the upper receptacle to the upper tray, wherein the support wall is attached to the top of the upper tray, to a distal end of the upper receptacle, and to an outer portion of the upper receptacle around a circumference of the upper receptacle adjacent an outer diameter of the bottle such that the support wall attaches to the upper receptacle adjacent to the body portion of the bottle and the shoulder portion of the bottle; and wherein the upper tray lacks a support wall attached around the neck of the bottle.

2. The shipping container of claim 1, further comprising a cardboard box, the lower tray and upper tray being located in the cardboard box so as to space a bottle apart from the cardboard box.

3. The shipping container of claim 1, wherein the lower receptacle has a ridge formed in the bottom thereof, and wherein the ridge spaces the bottle apart from the cardboard box.

4. The shipping container of claim 1, wherein the upper tray and the lower tray each comprises a plurality of respective upper and lower receptacles placed adjacent each other and to support a plurality of bottles.

5. The shipping container of claim 1, wherein the upper and lower trays are formed of a paper pulp and are nestable in other such upper and lower trays.

6. The shipping container of claim 1, wherein the upper receptacle comprises a generally hemispherical receptacle and wherein the support wall attaches to the upper receptacle adjacent an outer diameter of the upper receptacle.

7. The shipping container of claim 6, wherein the upper receptacle comprises an annular ring 40 extending upwardly from the top of the receptacle and curving inwardly at the top of the ring and a hole formed by the top of the ring.

8. The shipping container of claim 1, wherein the upper receptacle has a hole therethrough such that the neck of the bottle passes through the hole.

9. The shipping container of claim 1, wherein the support wall extends downwardly from the upper tray and attaches adjacent the bottom of the upper receptacle, and wherein the bottle neck begins above the attachment between the support wall and upper receptacle.

10. A shipping container for bottles having a body portion of a first size, a neck portion of a reduced size, and a shoulder portion defining a transition between the body portion and the neck portion, the shipping container comprising:

a box;

a lower tray placed into the bottom of the box, the lower tray contacting the lower surface and lower edges of the box, the lower tray having a lower receptacle formed therein for receiving the bottom of a bottle;

an upper tray placed into the top of the box, the upper tray contacting the upper surface and upper edges of the box, the upper tray having an upper receptacle formed therein which extends around the shoulder at the body, the upper tray having a support wall attaching the upper receptacle to the upper tray, the support wall being attached to the top of the upper tray adjacent the top of the box, attached to a distal end of the upper receptacle, and attached to the upper receptacle adjacent a location where the shoulder portion meets the body portion of a bottle which is placed therein; and wherein the upper tray lacks a support wall attached around the neck of the bottle.

11. The shipping container of claim 10, wherein the lower receptacle comprises a ridge formed in the bottom thereof, the ridge spacing the bottle apart from the box.

12. The shipping container of claim 10, wherein the upper receptacle comprises a curved concave receptacle with a hole formed at the top thereof.

13. The shipping container of claim 8, wherein the upper receptacle extends above the attachment between the upper receptacle and the support wall, and wherein the bottle is received into the upper receptacle such that the neck portion is located above the attachment between the support wall and the upper receptacle.

14. The shipping container of claim 10, wherein the support wall is attached to the upper receptacle adjacent an outer perimeter of the upper receptacle.

15. The shipping container of claim 10, wherein the attachment between the support wall and the upper receptacle defines an opening which is similar in size to the body portion of the bottle.

16. A shipping container for bottles having a body portion of a first diameter, a neck portion of a reduced diameter, and a shoulder portion which transitions between the body portion and the neck portion, the shipping container comprising:

a lower tray, the lower tray comprising:

a lower receptacle for receiving the bottom of a bottle; and an upper tray, the upper tray comprising:

an upper receptacle for receiving the shoulder portion of a bottle such that the upper receptacle contacts the shoulder of the bottle and generally encloses the shoulder between the neck and the body; and a support wall attaching the upper receptacle to the upper tray, wherein the support wall is attached to the top of the upper tray and to the upper receptacle at a location adjacent where the shoulder meets the body at the first diameter of the bottle; and wherein the upper tray lacks a support wall attached around the neck of the bottle.

17. The shipping container of claim 16, further comprising a box, and wherein the lower tray and upper tray are located in the box so as to space a bottle apart from the box.

18. The shipping container of claim 16, wherein the upper tray and the lower tray each comprise a plurality of respective upper and lower receptacles placed adjacent each other to receive a plurality of bottles therein.

19. The shipping container of claim 16, wherein the upper receptacle has a hole therethrough such that the neck of the bottle passes through the hole.

20. The shipping container of claim 16, wherein the support wall is attached to the upper receptacle adjacent the bottom of the upper receptacle.

* * * * *